US012186648B2

(12) United States Patent
Riou et al.

(10) Patent No.: US 12,186,648 B2
(45) Date of Patent: Jan. 7, 2025

(54) OFF-ICE TRAINING BLADE AND SKATE

(71) Applicant: Alien Kinetics Technologies Inc., Saskatoon (CA)

(72) Inventors: Kelly Riou, Saskatoon (CA); Zenon Dragan, Saskatoon (CA); Cory Furman, Regina (CA)

(73) Assignee: Alien Kinetics Technologies Inc., Saskatoon (CA)

( * ) Notice: Subject to any disclaimer, the term of this patent is extended or adjusted under 35 U.S.C. 154(b) by 18 days.

(21) Appl. No.: 18/019,606

(22) PCT Filed: Aug. 5, 2021

(86) PCT No.: PCT/CA2021/000060
§ 371 (c)(1),
(2) Date: Feb. 3, 2023

(87) PCT Pub. No.: WO2022/027125
PCT Pub. Date: Feb. 10, 2022

(65) Prior Publication Data

US 2024/0009545 A1 Jan. 11, 2024

(30) Foreign Application Priority Data

Aug. 5, 2020 (CA) ..... 3089463
Jan. 14, 2021 (CA) ..... 3105845

(51) Int. Cl.
*A63C 1/30* (2006.01)

(52) U.S. Cl.
CPC ..... *A63C 1/303* (2013.01)

(58) Field of Classification Search
CPC ..... A63C 1/303; A63C 1/32; A63C 1/30
See application file for complete search history.

(56) References Cited

U.S. PATENT DOCUMENTS 3,497,211 A * 2/1970 Nagin ..... A63C 19/10 280/18
3,689,091 A * 9/1972 Nagin ..... A63C 17/18 280/11.12
8,297,627 B2 * 10/2012 Smith ..... A63C 1/32 280/11.18
9,756,897 B1 * 9/2017 Millis ..... A63C 3/00
(Continued)

*Primary Examiner* — Brian L Swenson
(74) *Attorney, Agent, or Firm* — Christopher A. Proskey; BrownWinick Law Firm

(57) ABSTRACT

A removeable off-ice training blade for use in a convertible ice skate on a non-ice training surface. The blade has an upper retention surface shaped to engage the interior of a blade-holding groove and retention mechanism of the skate and has a lower tread to engage the non-ice training surface. Two side surfaces extend substantially perpendicularly from the lower tread to meet the upper retention surface. The tread surface comprises reflective non-cutting axial edges, to negate any destruction of the non-ice training surface during use of the blade. Certain embodiments of the training blade will include a tread surface that is wider than the upper retention surface, achieved with multiple lower profiles and cross-sections of the blade. Insofar as the training blade will not permit on-ice skating use, it can be removed from the skate for replacement with an ice blade having cutting edges. A skate incorporating the blade, and a related exercise method, are also disclosed.

23 Claims, 8 Drawing Sheets

(56) References Cited

U.S. PATENT DOCUMENTS

| | | | | |
|---|---|---|---|---|
| 2014/0015208 | A1* | 1/2014 | Pokupec | A63C 1/36 280/7.1 |
| 2014/0110909 | A1* | 4/2014 | Pokupec | A43B 5/18 280/11.12 |
| 2014/0319790 | A1* | 10/2014 | Mayer | A63C 1/303 280/11.18 |
| 2016/0242496 | A1* | 8/2016 | Barnes | A43B 3/244 |
| 2016/0256765 | A1* | 9/2016 | Dahlo | A63C 1/32 |
| 2020/0368602 | A1* | 11/2020 | Bollis | A63C 3/04 |

* cited by examiner

OFF-ICE TRAINING BLADE AND SKATE

This invention is in the field of athletic training equipment, and more particularly is a off-ice skate training device for use in balance and other physical training exercises.

BACKGROUND OF THE INVENTION

There are many approaches taken to skills and muscle development for various types of sports. Many of these approaches involve the use of customized devices and equipment, which can potentially increase the cost and complexity associated with off field or off-season training for athletes in many sports.

One of the sports in which such development challenges and opportunities exist is hockey, and other ice sports. In hockey the majority of the training which needs to take place to enhance and strengthen the stride and stability of the skater relates to core and lower body exercises. Maximum benefit can be gained in the training of the use of lower body skating stride muscles by actually creating opportunities and equipment by which a hockey player or other skater can practice and train off-ice in their skates. Off-ice training in skates allows for the athlete to practice their balance and strengthen their muscles on the same type of gate images that would be used on the ice, and also permits a player to practice stickhandling, shooting and other hockey related skills on skates and skate blades such that the geometry of those motions on-ice versus off-ice is most completely replicated.

Traditional ice skate blades, including removable blades for use on convertible skates as used in the prior art, are purposely extremely sharp for the purpose of skating on an ice surface. The sharp axial edges which are required to provide a sharp skating image, potentially combined with a concave bottom radial surface of an ice skate blade between its sharp axial edges, result in the physical concentration and focus of the weight of the skater on those very small edges and exerting weight on a non-ice training surface with a sharp or even semi-sharp ice edge on a skate blade is bound to be extremely destructive to the non-ice training surface on which the skate is used, cutting or scratching many of the hardest potential flooring materials.

Finding a way for a skater to conduct certain off-ice training wearing skates that most closely replicate the on-ice skating experience would it is believed to be well received by training facilities and elite hockey players wishing to maximize the accuracy, consistency and similarity between their off-ice and on-ice training experiences.

In the prior art, people have tried a number of approaches to practicing off-ice in their skates. For example practicing off-ice in skates with covers on the blades—an attachable cover is placed on the steel blade such that it protects the floor thereunder. The problem with this approach is that to develop an effective cover to be used on a skate blade which will minimize or negate the possibility for destruction of the training surface requires a reasonably thick or hard cover material also to be used and the application of such a cover to the skate blade can create extra thickness on the bottom of the skate which results in the edge of the blade being too low or too wide, impacting the real-life feel of the blade and the blade edge on the training surface. If covers are used that are not of sufficient strength or appropriate material they can also potentially be ruined or cut easily, resulting in the waste of a lot of cover material.

Most newer hockey skates, at least those of the primary brands, allow for the use of interchangeable ice blades. The skate boot includes a holder on the bottom which allows for the releasable attachment of ice blades there to, and when a particular set of ice blades needs to have the edges sharpened or otherwise be modified or removed, they can simply be releasably removed and another pair attached in their place. Another approach that has been used in training has been to remove the blades from removable blade skates to train on the bare blade holder on the bottom of the skate. This does not provide the ideal geometry again in terms of perfect positioning of the body of the player in relation to the training surface, and can also result in significant damage to the retention mechanism and the actual holder on the bottom of the skate boot, prematurely ruining the holders for on-ice use.

Certain prior art approaches to the permission of the use of the ice-skating blade with sharp ice cutting edges on a non-ice training surface require the covering of the non-ice training surface with a hard rubber surface or other similar material which will permit for the safe use of a traditional ice blade on and off-ice surface, but the cost of converting off-ice surfaces to be covered in such material is significant and it is desirable to provide an invention that could provide the ability for nondestructive off-ice use of ice skates with blades without the need for expensive retrofit of the floor or other surface on which those skates and off-ice blades are going to be used. Providing the ability to convert a convertible ice skate by the incorporation of a removable off-ice training blade with noncutting edges will permit for enhanced training opportunities for hockey players and other athletes without the need for expensive retrofit or outfitting of workout spaces and the like and on this basis it is felt that the removable off-ice training blade of the present invention with his noncutting axial edges will be a substantial improvement over the current state-of-the-art and will be broadly accepted in the industry.

SUMMARY OF THE INVENTION

In one embodiment, the invention comprises a removable off-ice training blade for use in a convertible ice skate, being a skate with a removable blade holder. The removable off-ice training blade would permit the use of the ice skate on a non-ice training surface without fear of destruction of the non-ice training surface. The removable off-ice training blade could be used on many different types of convertible ice skates as are available even in a prior art context in the market at the present time, comprising a releasable skate blade holder attached to the bottom of a skate boot. The skate blade holder has an axial blade holding groove along the bottom of the holder which engages and aligns the skate blade with a skating axis of a foot of the wearer of the skate. The skating axis extends from the heel to the toe of the boot. The skate holder also includes a releasable retention mechanism for retaining a skate blade within the blade holding groove during use. Existing ice skates which include blade holders with a retention mechanism are used to allow for the interchangeable swapping of different on-ice skating blades on to the skate boot as required by the wearer.

The removable off-ice training by itself could be made of different materials and have different qualities and characteristics but generally speaking would be manufactured for placement and alignment within the blade holding groove of a skate holder having same and for retention therein by the associated releasable retention mechanism. The blade would comprise an upper retention surface which was shaped to engage the interior of the blade holding groove and to be retained therein by the retention mechanism. Where the removable off-ice training by the present invention was going to be used with currently available skate and skate blade holders in the marketplace, the upper retention surface of the blade could be manufactured with the necessary locking tabs, holes or other requirements to be engaged and retained by the pre-existing retention mechanism of the skate boots and holders in question. As will be outlined below, a specific convertible ice skate could also be manufactured with a particular type of retention mechanism maximized for effectiveness of the use of the training blade of the present invention and the shaping of the upper retention surface of the training blade to engage such a blade holder and skate boot are also contemplated within the scope of the present invention.

The specific shaping of the upper retention surface of the training blade accessory of the present invention is contemplated to take varying shapes in manufacture to be used in a retrofit context with existing skates and skate blade holders manufactured by different companies. The specifics of the means of attachment and the related specific shaping of the upper retention surface of the training blade accessory insofar as it would bury for use with different blade holders does not specifically intended to be within the scope of the present invention.

The removable off-ice training blade would also include a lower tread surface which would engage the non-ice training surface on which training was to take place and which it was desired to protect through the use of the training blade of the present invention. As outlined elsewhere and throughout, the intention of the present invention is to provide an off-ice training blade for use on a non-ice training surface which will not damage the training surface when used, as well as to provide a enhanced training mechanism for use by hockey players and other skaters to enhance balance and training geometry, and do other physical training exercises.

The training blade will have heel and toe ends, which correspond to the heel and toe end of the skate boot, along with two side surfaces each of which extend substantially perpendicularly downwards from the upper retention edge to meet the lower tread of the blade, in reflective non-cutting axial edges. The non-cutting axial edges of the tread would explicitly not comprise cutting edges which are needed on an ice surface for the purpose of skating. The non-cutting axial edges of the training blade are contemplated to be convex, or rounded, to mitigate any likely destruction of the non-ice training surface during use of the training blade by the wearer in a skate in training exercises. Between the convex nature of the non-cutting axial edges of the training blade in question as well as potentially in a combination with the choice of the material of manufacture, using the training blade as disclosed will not result in destruction of the non-ice training surface.

The training blade is also manufactured to be removable from the blade holder of a skate for replacement with a removable ice skating blade which has cutting edges for use on-ice as required, by releasing the retention mechanism of the associated blade holder.

As outlined above, the upper retention surface of certain embodiments of the removable off-ice training of the present invention could further comprise skate engaging means which were useful to engage the blade holder of the skate for the releasable retention mechanism of skate in question. Again, various types of skating engaging means could be included on the upper retention surface of the training blade in question for the purpose of accommodating attachment of the training blade to various types of skate blade holders and any type of skate engaging means which could be manufactured into the upper retention surface of a training blade such as outlined for the purpose of engaging such a skate blade holder are all contemplated within the scope of the present invention.

In many embodiments, the non-cutting axial edges of the tread will result in the training surface of the blade cross-sectionally comprising a convex curve extending outwardly between the axial edges of the tread. In certain embodiments, with a convex curve between the axial edges of the tread, the center of the convex curve would be in the center of the training surface, equidistant from the axial edges of the tread.

In alternate embodiments of the off-ice training blade of the present invention the training surface of the tread could be flat from side to side between the axial edges. Any type of a non-cutting tread surface profile between the axial edges of the tread which would allow for the support of the wearer when the blade was used, while lacking any ability to cut the training surface on which the skate blade were being used for training purposes will all be understood to be within the scope of the present invention.

In addition to the rounded non-cutting axial edges, the training blade could also be manufactured of nonmetal material to further remove the ability of the training blade to cut the non-ice training surface on which the state and blade were being used for training purposes. That material of manufacture might be plastic. It will also be understood that in certain cases metal could be used for the manufacture of the training by the present invention.

In certain embodiments of the removable training blade of the present invention, the cross-sectional profile of the blade could be tapered from the upper retention surface to the tread surface i.e. the tread could be wider than the upper retention surface to provide additional support to the wearer when in use. The tread surface of the blade, as it extends from the heel end to the toe end of the blade, could have a number of different heel-to-toe shapes which would be used for different training purposes. Those shapes could include a flat surface extending from the heel end to the toe end of the blade which will engage the training surface in parallel and result in an upright standing position of the wearer. An alternate heel-to-toe shape of the tread of the blade could be a radially shaped profile extending from the heel end to the toe end of the blade which corresponds to the radial profile of a selected on-ice blade of the skate and which would allow for the closest possible feeling approximating on-ice activity using the non-cutting training blade accessory of the present invention. For specific training purposes, the heel-to-toe shape of the tread could also comprise an inclined surface from the toe end to the heel end of the blade wherein the blade is taller at the heel end whereby the wearer would be in a pitched forward standing position when standing on the skate. Conversely, the heel-to-toe shape can also comprise a declined surface between the toe end in the heel end of the blade wherein the blade is taller at the toe end then whereby a wearer would be in a pitched backward standing position when standing on a skate using the blade in question.

In addition to the varying embodiments of a removable training blade for use with an ice skate, the invention also includes a convertible ice skate for training used by a wearer on a non-ice training surface which skate includes the training blade of the present invention. The skate itself comprises a skate boot having a heel end and a toe end along with a releasable skate blade holder attached to the bottom of the skate boot which comprises an axial blade holding groove along the bottom of the holder for engagement and alignment of the skate blade with a skating axis of a foot of the wearer which extends from the heel to toe of the boot, and a releasable retention mechanism for retaining the skate blade within the groove during use. The releasable retention mechanism could comprise any number of currently available retention mechanisms in conjunction with releasable skate blade holders already available in the marketplace, or the releasable skate blade holder could be a traditional bolt in blade holder or other type of a blade holder for use in conjunction with the remainder of the skate boot outlined and all such approaches are contemplated within the scope of the present invention.

In addition to a skate boot and the releasable skate blade holder, the convertible ice skate of the present invention would include a removable off-ice training blade retained within the skate blade holder. The removable off-ice training blade would be in accordance with the embodiments of the blade of the present invention previously outlined and specifically would have an upper retention surface shaped to engage the interior of the blade holding groove and be retained therein by the retention mechanism, along with a tread surface to engage the non-ice training surface. The blade would have heel and toe ends corresponding to the heel and toe ends of the skate boot, as well as two side surfaces extending substantially perpendicularly from the upper retention edge to meet the lower tread of the blade in reflective non-cutting axial edges. The non-cutting axial edges of the tread would negate any destruction of the non-ice training surface during use of the skate by the wearer thereon and the training blade could be removed from the skate via the release of the retention mechanism to allow for its replacement with a skating blade having cutting edges for use on-ice as required.

The skate of the present invention could also be a skate having a permanently attached off-ice training blade, rather than a convertible skate with a removable blade holder. In a permanently manufactured training skate embodiment, the training blade could comprise the training blade accessory of any embodiment outlined herein with any necessary modification for permanent attachment to the skate blade holder of the training skate. A training skate could also be created within the scope of the present invention which would comprise a blade holder extending downward from the boot which integrally included a lower tread surface in accordance with the remainder of the training blade disclosure outlined herein. A combined blade holder and blade used in a training skate for permanent attachment as outlined will be understood to those skilled in the art and is also contemplated within the scope of the present invention.

Also disclosed is a method of off-ice training for a skater on a non-ice training surface. The method comprises first providing at least one convertible ice skate to be worn on a foot of the skater, said skate comprising a skate boot having a heel end a toe; a releasable skate blade holder attached to the bottom of the skate boot comprising an axial blade-holding groove along the bottom of the holder for engagement and alignment of a skate blade with a skating axis of a foot of the wearer, said skating axis extending from the heel to the toe of the boot, and a releasable retention mechanism for retaining the skate blade within the groove during use; and a removeable off-ice training blade having heel and toe ends corresponding the heel and toe of the skate boot, retained within the blade holder and comprising an upper retention surface shaped to engage the interior of the blade-holding groove and be retained therein by the retention mechanism, a lower tread surface to engage a non-ice training surface, said tread surface having reflective non-cutting axial edges shaped to negate any destruction of the non-ice training surface, and two side surfaces extending substantially perpendicularly from the tread to meet the upper retention edge.

The skater will put the convertible ice skates on one or both of their feet, and then engage in weight-bearing exercise movements on said at least one convertible ice skate on the non-ice training surface. The training blade of each convertible ice skate, via its non-cutting axial tread edges, does not damage the non-ice training surface; and the skater is able to simulate weight-bearing skate positioning and movements on the at least one convertible ice skate during the exercise movements.

The method could be practiced with one skate on a foot of the skater, or two skates on both feet of the skater.

The specifics of the weight bearing exercises which could be conducted vary.

DESCRIPTION OF THE DRAWINGS

While the invention is claimed in the concluding portions hereof, preferred embodiments are provided in the accompanying detailed description which may be best understood with the diagrams where like parts in each of the several diagrams are labeled with like numerals, and where:

DESCRIPTION OF THE ILLUSTRATED EMBODIMENTS

The removable off-ice training blade of the present invention, and the convertible and nonconvertible skates disclosed that incorporate the blade of the present invention are intended for use for training purposes of an ice skate on a non-ice training surface. The off-ice training blade of the present invention permits for the use of skates by an athlete during off-ice training, physical workouts etc. without the need to worry about destruction of the off-ice training surface, since the off-ice training blade of the present invention has nondestructive, noncutting axial tread edges that will not damage the training surface.

The present invention comprises a removable off-ice training blade for use in a convertible ice skate on a non-ice training surface, as well as a convertible ice skate which in combination with a removable off-ice training blade can be used on the non-ice training surface and can be converted for ice use by the removal of the off-ice training blade of the present invention and its replacement with an on-ice blade with cutting ice edges.

The off-ice training blade of the present invention is intended for use in a releasable skate blade holder attached to the bottom of skate boot which has an axial blade holding groove along the bottom of the holder for engagement and alignment of a skate blade with a skating axis of the foot of the wearer, which extends from the heel to the toe of the boot. The releasable skate blade holder also comprises a releasable retention mechanism for retaining the skate blade within the groove during use of the skate. In prior art skates, for retrofit use of the off-ice training blade the present invention, there are multiple types of releasable retention mechanisms known in the art, and the off-ice training blade of the present invention could be manufactured to accommodate such pre-existing releasable retention mechanisms and skate blade holders, or a particular skate blade holder and releasable retention mechanism could also be created for this purpose of the present invention.

Figure 1:
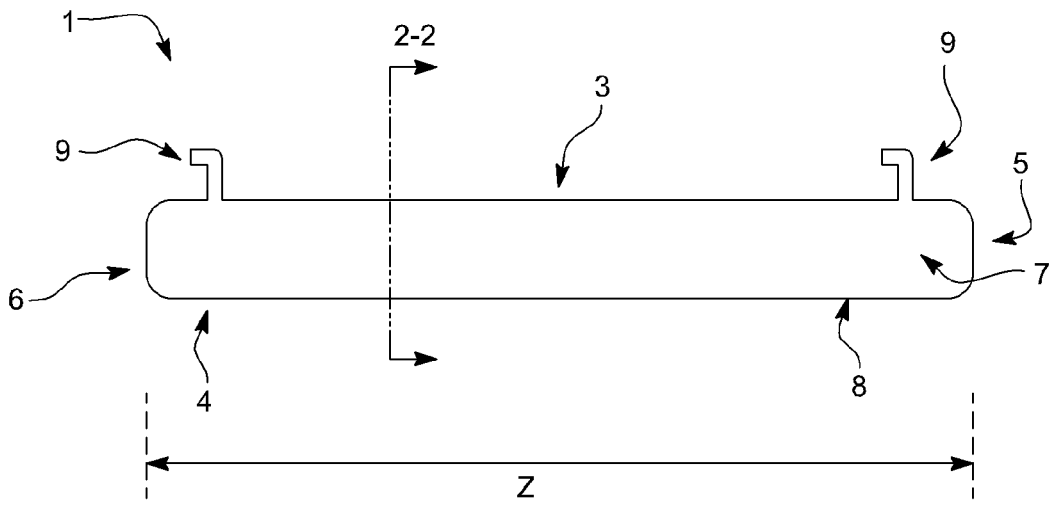
FIG. 1 is a perspective view of one embodiment of the removeable off-ice training blade of the present invention.

Referring to FIG. 1 there is shown a first sample embodiment of the removable off-ice training blade 1 of the present invention. The blade 1 comprises a blade simulating element for use on off-ice surfaces in conjunction with a convertible ice skate having a removeable blade holder. The blade 1 has a length 2 which when installed in the skate blade holder of the skate corresponds to the skating axis of the foot of the wearer. The blade 1 has an upper retention surface 3 along its length 2 which is shaped to engage the interior of a blade holding groove of a skate blade holder of a skate, and to be retained therein by a retention mechanism.

Also shown in the blade 1 of FIG. 1 is a tread surface 4 which is the surface of the blade 1 which will engage the non-ice training surface on which it is intended to be used for training or other non-skating purposes.

The off-ice training blade 1 would also have heel and toe ends 5, 6 which correspond to the heel and toe of the skate boot into which the blade 1 would be installed, which are shown in this Figure simply for reference to elements and axes of the blade etc.

In addition to the upper retention surface 3 and the tread surface 4 of the blade 1, the blade 1 also is comprised of two side surfaces 7 which extend substantially perpendicularly from the upper retention edge 3 to meet the lower tread 4 in reflective noncutting axial edges 8. The shape of the noncutting axial edges 8 is key to the present invention—the tread 4 will have noncutting axial edges 8 which are specifically shaped and manufactured to avoid destruction or cutting of the off-ice surface on which the blade 1 would be used. Various shapes or profiles of the noncutting axial edges 8 of the blade 1 are contemplated that will achieve the objective of permitting the feel of a blade in place on the skate for the wearer when the skate is used in off-ice training applications while avoiding the cutting and destruction of the off-ice training surface which would be inflicted by a standard sharpened ice-skating blade with sharpened edges or a concave bottom surface.

As outlined throughout, the noncutting axial edges 8 of the blade 1 as shown are rounded, to negate any destruction of the non-ice training surface during use of the skate including the blade thereon. It will be understood that there could be other cross-sectional profiles of the noncutting axial edges 8 in addition to rounding them which would have the same effect of rendering them nondestructive to the training surface and all such approaches are also contemplated within the scope of the present invention.

The training blade 1 can be removed from the blade holder of a skate for replacement with a ice blade that has cutting edges for use on the ice as required, by releasing the retention mechanism of the skate blade holder on the skate.

The blade 1 also shows skate engaging means 9 on the upper retention surface 3 which are intended to engage the blade holder or the releasable retention mechanism of the skate in conjunction with which the blade 1 will be used and allow for the releasable retention of the blade within the blade holder of the skate during use.

Figure 2:
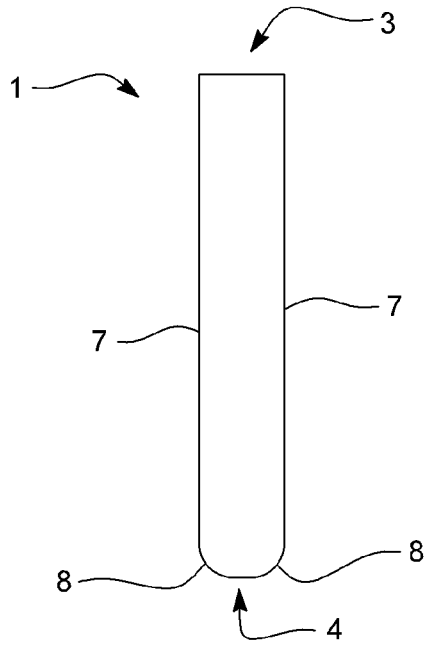
FIG. 2 shows a cross-sectional view of the embodiment of FIG. 1.

FIG. 2 is a cross-sectional view of the blade 1 of FIG. 1 along line 2-2 of FIG. 1, demonstrating in cross-sectional view a number of the elements of the off-ice training blade 1 of the present invention as otherwise outlined above.

Figure 3:
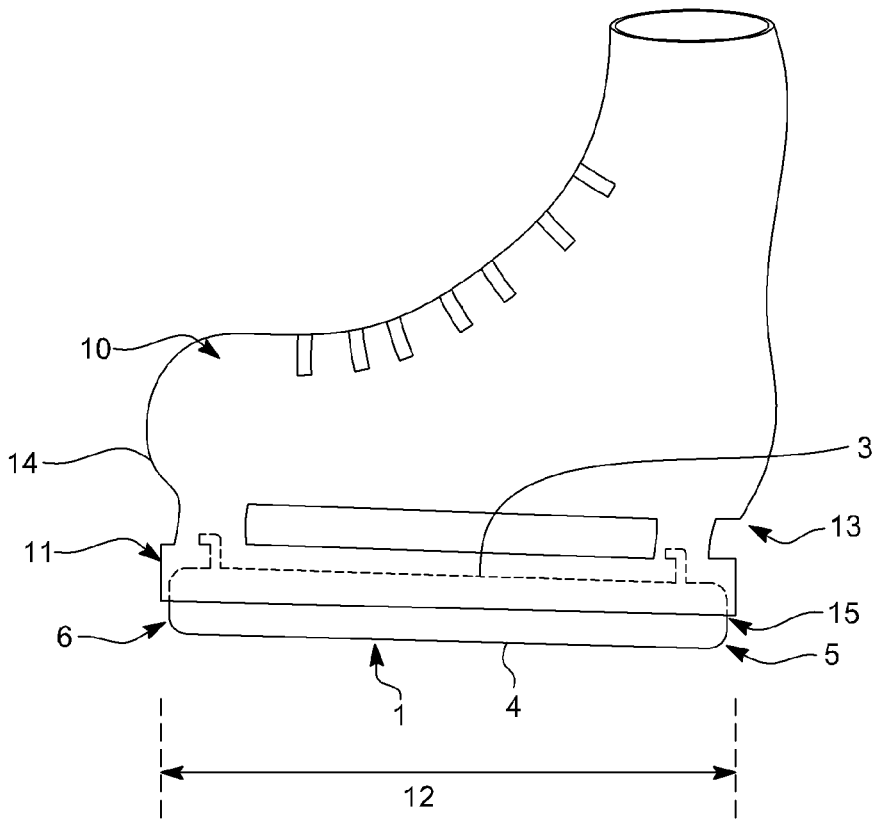
FIG. 3 is a perspective view of the embodiment of FIG. 1, shown in position in a skate boot.

FIG. 3 shows the blade 1 in position within a blade holder 11 of a convertible ice skate 10. The skating axis 12 of the skate and the foot of the wearer is shown, along with the heel and toe ends 13, 14 of the skate boot corresponding to the heel and toe ends 5, 6 of the blade 1. The blade 1 is positioned within the axial blade holding groove 15 on the bottom of the blade holder 11. As outlined above various types of releasable retention mechanisms will be understood to those skilled in the art of skate design and manufacture as many different skate manufacturing companies currently manufacture skate blade holders 11 with different types of releasable retention mechanisms for holding removable blades therein. It is specifically contemplated that the blade 1 of the present invention will be manufactured with an appropriate upper retention surface 3 and any necessary potential skate engagement means to permit the substitution or use of the off-ice training blade 1 of the present invention in conjunction with any type of a skate blade holder for use on hockey, figure or other ice skates. The specifics of the releasable retention mechanism and the necessary attachment modifications to the blade 1 of the present invention will be understood to all be contemplated within the scope of the present invention without comprising claimed specific subject matter.

As shown in the embodiment of FIGS. 1 and 2, it is specifically contemplated that the tread surface 4 between the noncutting axial edges 8 thereof could comprise a convex curve as shown to result in the noncutting behaviour of the blade 1 of the present invention on a non-ice training surface. The centre of the convex curve could be in the centre of the tread 4, equidistant from the axial edges 8 of the training blade as shown, or in specific manufacture or training use scenarios, the centre of the convex curve could be positioned closer to one or the other axial edge 8 of the tread 4. Any type of a cross-sectional/edge profile for the noncutting axial edges 8 of the tread which results in a shape that could generally speaking be described as rounded and will result in the noncutting and nondestructive behaviour of the training blade 1 when used on a non-ice training surface are intended to be within the scope of the present invention.

As shown in the cross-sectional view of FIG. 2, the tread 4 of the blade 1 shown is rounded along its edges but is flatter towards the centre of the blade along the axis and length thereof. The nonutility for on-ice skating purposes of the training blade 1 of the present invention will be understood to those skilled in the art, while the nondestructive and noncutting behaviour of the blade 1 of the present invention used on a non-ice training surface will still have substantial benefits for off-ice skating purposes. The blade 1 of the present invention has a single-purpose namely for off-ice use and would have no utility in on-ice or skating applications. Skaters with convertible ice skates which would accommodate the off-ice training blade 1 of the present invention are already using skates that accommodate removable skating blades for use on-ice and there is no intention of the present invention to encroach upon the on-ice use scenario, but rather to provide an ability to practice in off-ice environments nondestructively and cost-effectively which is not currently possible using convertible skates or even nonconvertible skates that include sharpened skating edges thereon.

Figure 4:
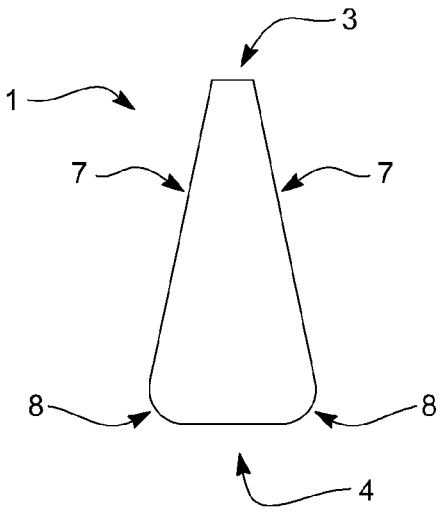
FIG. 4 shows a cross-sectional view of an alternate embodiment of the training blade of the present invention wherein the tread is wider than the upper skate engaging surface thereof.

FIG. 4 demonstrates a cross-sectional view of another embodiment of the blade 1 of the present invention, where the tread 4 is wider than the upper retention surface 3.

The heel-to-toe shape of the tread 4 along its length could also be modified or varied in numerous ways without departing from the intended scope of the present invention so long as the noncutting nature of the axial edges 8 of the tread 4 are maintained. FIGS. 5A through 5D show a side view of a number of different embodiments of blades 1 in accordance with the present invention with different heel-to-toe shapes. For example, the tread 4 could be flat between the heel and toe ends 5, 6 resulting in the engagement of the non-ice training surface in parallel and which would result in an upright standing position of the wearer when the tread 4 was in full contact with the non-ice training surface (shown in FIG. 5A). In other cases, the skater may wish to use a blade 1 in accordance with the remainder of the present invention that had a heel-to-toe shape on its tread 4 that was radially shaped, corresponding to the radially shaped profile of a selected on-ice blade of the skate. This would provide the closest simulated off-ice use of a skate to the on-ice blades that are used by a skater. See FIG. 5B.

Figure 5A:
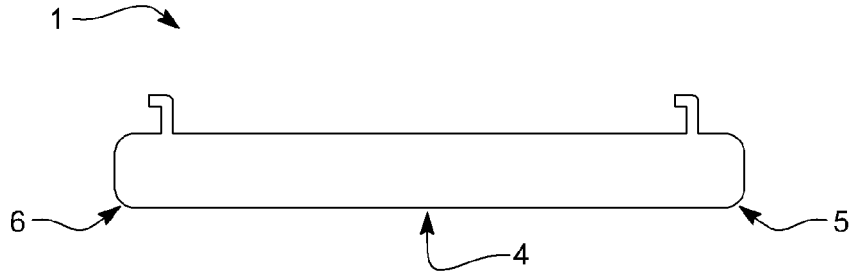
FIG. 5 shows a side profile of different versions of the blade of FIG. 1, demonstrating different heel-to-toe shapes of the blade and the tread.
Figure 5B:
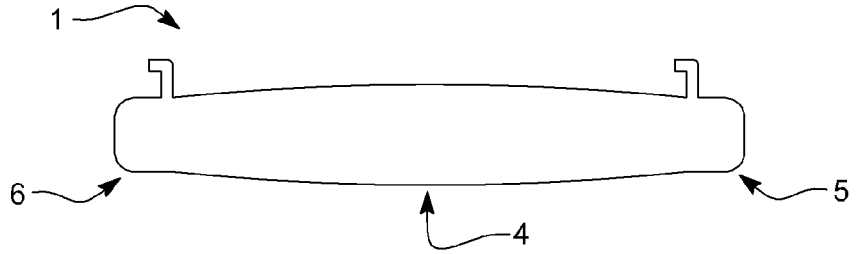
Figure 5C:
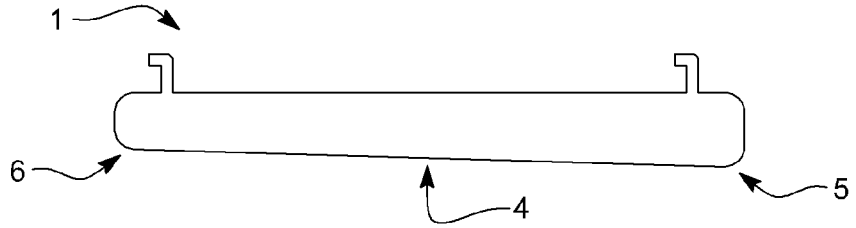
Figure 5D:
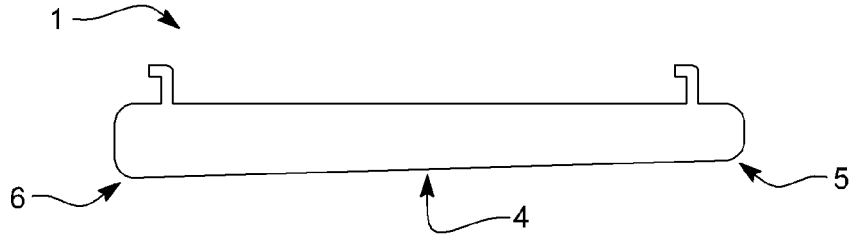

The tread 4 could also be inclined from the toe end 5 to the heel end 6 of the blade 1 wherein the blade 1 was taller at the heel end 6 and whereby the wearer would be pitched forward in their standing position when standing on the skate accommodating the blade 1 with the tread 4 in full contact with the non-ice training surface (FIG. 5C). Conversely, the tread 4 could also be declined from the toe end 6 to the heel end 5 of the tread 4 wherein the blade would be taller at the toe end 6 and whereby the wearer would be in a pitched backward standing position when standing on a skate using the blade 1. (FIG. 5D)

Any type of a removable training blade 1 for use in conjunction with a convertible ice skate regardless of the nature and detail of the attachment mechanism used to retain the blade within the boot of the particular ice skate in question which has rounded axial cutting edges as outlined for the purpose of nondestructive interaction with an off-ice surface for training or other purposes, without the need to retrofit the off-ice surface with mats or other material that minimize the destructability of the surface itself are all intended to be encompassed within the scope of the present invention and any modifications within the general scope of this subject matter to maximize the nondestructive behaviour of the blade or maximize training outcomes will all be understood to be encompassed herein as well.

The material of manufacture of the training blade of the present invention, on a standalone basis or for use in conjunction with a convertible ice skate, could be selected from a large group of materials including metal and plastic flats or sheets from which the training blade of the present invention could be cut, machined or moulded. All of these various types of material will be understood to those skilled in the art of manufacture, and any type of a material of manufacture for the off-ice training blade of the present invention which achieves its objectives as otherwise outlined herein are contemplated within the scope hereof.

Figure 6:
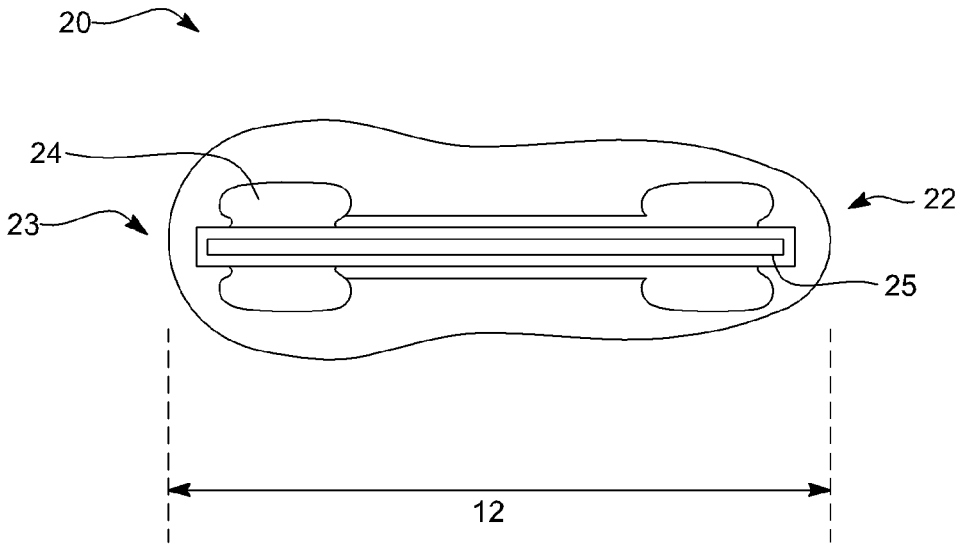
FIG. 6 is a perspective view of one embodiment of the convertible ice training skate of the present invention.

There is also disclosed a convertible ice skate for training used by a wearer on a non-ice training surface. FIG. 6 is a perspective view of one embodiment of the convertible ice training skate 20 of the present invention. The skate 20 comprises a skate boot 21 having a heel 22 and a toe 23 corresponding to a heel end 13 and a toe end 14. There is a releasable skate blade holder 24 attached to the bottom of the skate boot 21 which in turn comprises an axial blade holding groove 25 along the bottom of the holder 24 defining the bottom of the skate closest to the ice surface. The axial blade holding groove 25 is used to engage in a line a skate blade 1 such as that disclosed above with a skating axis of a foot of the wearer which extends from the heel 22 to the toe 23 of the boot 21. The holder 24 also comprises a releasable retention mechanism 26 for retaining a skate blade 1 within the groove 25 during use.

The convertible ice skate 20 also includes a removable off-ice training blade 1 retained within the skate plate holder 24. The blade 1 is any blade of the present invention as otherwise outlined herein which comprises a blade simulating element for non-destructive use on off-ice surfaces. The blade 1 has an upper retention surface 3 along its length 2 which is shaped to engage the interior of the blade holding groove 25 and to be retained therein by the retention mechanism 26.

The blade 1 has a tread surface 4 which will engage the non-ice training surface on which it is intended to be used for training or other non-skating purposes. The blade 1 could also be worn transitionally on a skate on an ice surface but it will be understood to those skilled in the art that the noncutting edges, as purposely manufactured in the present invention, of the blade 1 would result in no gliding ability and no ability to use the off-ice training blade of the present invention for skating purposes.

In addition to the upper retention surface 3 and the tread surface 4 of the blade 1, the blade 1 also is comprised of two side surfaces 7 which extend substantially perpendicularly from the upper retention edge 3 to meet the lower tread 4 in reflective noncutting axial edges 8. The shape of the noncutting axial edges 8 is key to the present invention—the tread 4 and blade 1 will have noncutting axial edges 8 which are specifically shaped and manufactured to avoid destruction or cutting of the off-ice surface on which the blade 1 would be used. Various shapes or profiles of the noncutting axial edges 8 of the blade 1 are contemplated that will achieve the objective of permitting the feel of a blade in place on the skate for the wearer when the skate is used in off-ice training application while avoiding the cutting and destruction of the off-ice training surface which would be inflicted by a standard skate blade with an ice cutting surface thereon. The noncutting axial edges 8 of the blade 1 are rounded, to negate destruction of the non-ice training surface during use of the skate including the blade thereon.

The convertible nature of the ice skate 20 arises from the fact that the training blade 1 can be removed from the blade holder 24 for replacement with a removable skating blade with cutting edges for use on-ice, as might be required, by releasing the retention mechanism 26.

The training blade 1 can be removed from the blade holder of a skate for replacement with a removable skating blade that has cutting edges for use on the ice as required, by releasing the retention mechanism of the skate blade holder on the skate.

Figure 7:
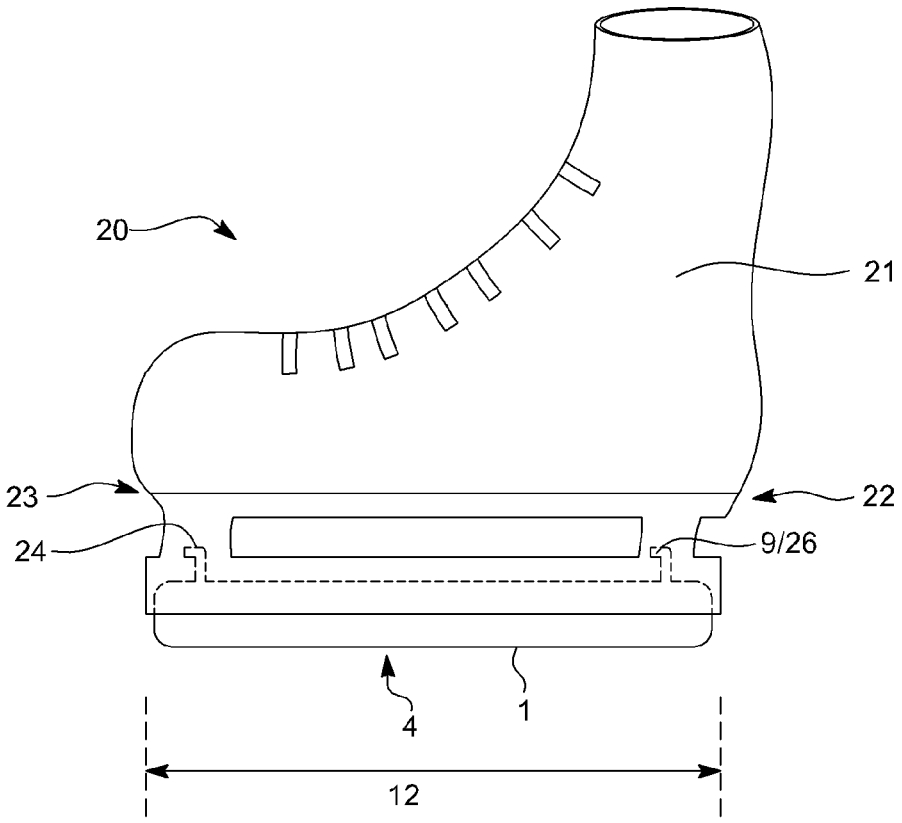
FIG. 7 is a bottom view of the embodiment of FIG. 6.
Figure 8:
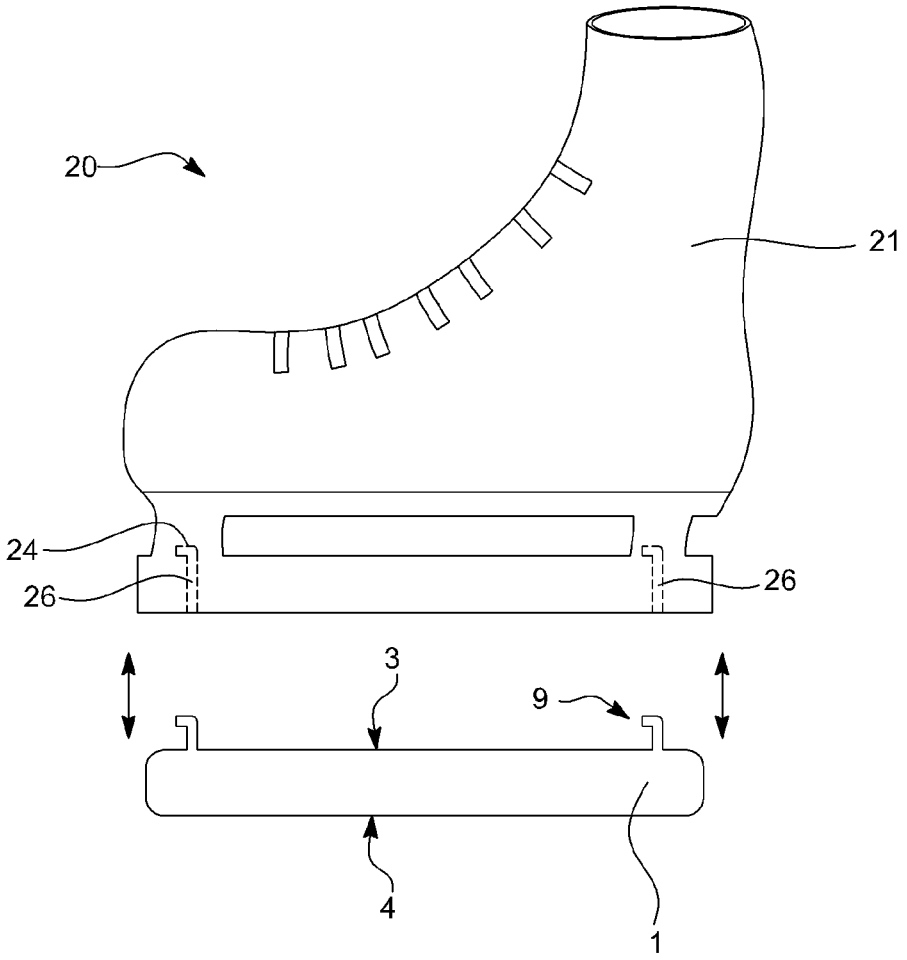
FIG. 8 is a perspective view of the embodiment of FIG. 6 with the blade shown in an exploded detached position.

FIG. 7 is a bottom view of the skate of FIG. 6, and FIG. 8 is a perspective view of the skate 20 of FIG. 6 with the blade 1 shown a spaced apart detached position.

Further embodiments of the present invention include permanent, versus convertible, skates, having the training blade accessory 1 of the present invention permanently installed on a skate boot for permanent use in a training application by a wearer. The training blade accessory used in any such skate embodiment could be any embodiment of the blade 1 otherwise outlined herein.

Also disclosed is a method of off-ice training for a skater on a non-ice training surface. The method comprises first providing at least one convertible ice skate to be worn on a foot of the skater, said skate comprising a skate boot having a heel end a toe; a releasable skate blade holder attached to the bottom of the skate boot comprising an axial blade-holding groove along the bottom of the holder for engagement and alignment of a skate blade with a skating axis of a foot of the wearer, said skating axis extending from the heel to the toe of the boot, and a releasable retention mechanism for retaining the skate blade within the groove during use; and a removeable off-ice training blade having heel and toe ends corresponding the heel and toe of the skate boot, retained within the blade holder and comprising an upper retention surface shaped to engage the interior of the blade-holding groove and be retained therein by the retention mechanism, a lower tread surface to engage a non-ice training surface, said tread surface having reflective non-cutting axial edges shaped to negate any destruction of the non-ice training surface, and two side surfaces extending substantially perpendicularly from the tread to meet the upper retention edge.

The skater will put the convertible ice skates on one or both of their feet, and then engage in weight-bearing exercise movements on said at least one convertible ice skate on the non-ice training surface. The training blade of each convertible ice skate, via its non-cutting axial tread edges, does not damage the non-ice training surface; and the skater is able to simulate weight-bearing skate positioning and movements on the at least one convertible ice skate during the exercise movements.

The method could be practiced with one skate on a foot of the skater, or two skates on both feet of the skater.

The skates and training blades used for the practice of the method could be any skates or training blades in accordance with the embodiments outlined herein.

Certain embodiments of the method might include a conversion step wherein the training blades are attached to the blade holders of the convertible skates in advance of the conduct of the exercise portions of the method.

The specifics of the weight bearing exercises which could be conducted vary.

It should also be apparent to those skilled in the art that many more modifications besides those already described are possible without departing from the inventive concepts herein. The inventive subject matter, therefore, is not to be restricted except in the scope of the appended claims. In interpreting both the specification and the claims, all terms should be interpreted in the broadest possible manner consistent with the context. The terms "comprises" and "comprising" should be interpreted as referring to elements, components, or steps in a non-exclusive manner, indicating that the referenced elements, components, or steps may be present, or utilized, or combined with other elements, components, or steps not expressly referenced.

What is claimed:

1. A removeable off-ice training blade for use in a convertible ice skate, wherein the skate comprises a skate boot with a releasable skate blade holder attached thereto having:

a. an axial blade-holding groove along the bottom of the holder for engagement and alignment of a skate blade with a skating axis of a foot of the wearer extending from the heel to the toe of the boot; and b. a releasable retention mechanism for retaining the skate blade within the groove during use;

said blade having heel and toe ends corresponding the heel and toe of the skate boot and comprising:

a. an upper retention surface shaped to engage the interior of the blade-holding groove and be retained therein by the retention mechanism;

b. a lower tread surface to engage a non-ice training surface, said tread surface having reflective non-cutting axial edges; and c. two side surfaces extending substantially perpendicularly from the tread to meet the upper retention edge;

wherein the non-cutting axial edges of the tread are shaped to negate any destruction of the non-ice training surface on which the training blade is used when attached to a skate boot;

wherein the tread has a high coefficient of friction to reduce the likelihood of slippage of the tread on the non-ice training surface; and wherein the training blade can be removed from the blade holder for replacement with an ice blade having cutting edges for use on-ice as desired, by releasing the retention mechanism.

2. The removeable off-ice training blade of claim 1 wherein the tread is approximately the same width as the ice cutting surface of a skating blade.

3. The removeable off-ice training blade of claim 1 wherein the tread is wider than ¼ of an inch.

4. The removeable off-ice training blade of claim 1 wherein the tread is flat.

5. The removeable off-ice training blade of claim 1 wherein the tread is approximately the same width as the upper retention surface.

6. The removeable off-ice training blade of claim 1 wherein the upper retention surface of the blade is shaped to be used in a blade holder of an ice skate.

7. The removeable off-ice training blade of claim 6 wherein the upper retention surface of the training blade further comprises skate engaging means to engage the blade holder or the releasable retention mechanism of the skate.

8. The removeable off-ice training blade of claim 7 wherein the skate-engaging means is shaped to be used in a blade holder of any ice skate.

9. The removeable off-ice training blade of claim 1 wherein the tread has a heel-to-toe shape selected from the following:

a. a flat surface between the heel and toe ends which will engage the non-ice training surface in parallel and result in an upright standing position of the wearer;

b. a radially shaped profile corresponding the radial profile of a selected ice blade of the skate;

c. an inclined surface from the toe end to the heel end of the blade, wherein the blade is taller at the heel end and whereby the wearer will be in a pitched forward standing position when standing on the skate; or d. a declined surface from the toe end to the heel end of the blade, wherein the blade is taller at the toe end and whereby the wearer will be in a pitched backward standing position when standing on the skate.

10. The removeable off-ice training blade of claim 1 wherein the training blade is made of metal, plastic or a composite material.

11. The removeable off-ice training blade of claim 1 wherein the skate is a hockey skate.

12. The removeable off-ice training blade of claim 1 wherein the skate is a figure skate.

13. A removeable off-ice training blade for use in a convertible ice skate, wherein the skate comprises a skate boot with a releasable skate blade bolder attached thereto having:

an axial blade-holding groove along the bottom of the holder for engagement and alignment of a skate blade with a skating axis of a foot of the wearer extending from the heel to the toe of the boot; and b. a releasable retention mechanism for retaining the skate blade within the groove during use;

said blade having heel and toe ends corresponding the heel and toe of the skate boot and comprising:

d. an upper retention surface shaped to engage the interior of the blade-holding groove and be retained therein by retention mechanism;

e. a lower tread surface to engage a non-ice training surface, said tread surface having reflective non-cutting axial edges; and f. two side surfaces extending substantially perpendicularly from the tread to meet the upper retention edge;

wherein the non-cutting axial edges of the tread are shaped to negate any destruction of the non-ice training surface on which the training blade is used when attached to a skate boot;

wherein the training blade can be removed from the blade holder for replacement with an ice blade having cutting edges for use on-ice as desired, by releasing the retention mechanism; and wherein the noncutting axial edges are rounded.

14. A removeable off-ice training blade for use in a convertible ice skate, wherein the skate comprises a skate boot with a releasable skate blade holder attached thereto having:

a. an axial blade-holding groove along the bottom of the holder for engagement and alignment of a skate blade with a skating axis of a foot of the wearer extending from the heel to the toe of the boot; and b. a releasable retention mechanism for retaining the skate blade within the groove during use;

said blade having heel and toe ends corresponding the heel and toe of the skate boot and comprising:

g. an upper retention surface shaped to engage the interior of the blade-holding groove and be retained therein by the retention mechanism;

h. a lower tread surface to engage a non-ice training surface, said tread surface having reflective non-cutting axial edges; and i. two side surfaces extending substantially perpendicularly from the tread to meet the upper retention edge;

wherein the non-cutting axial edges of the tread are shaped to negate any destruction of the non-ice training surface on which the training blade is used when attached to a skate boot;

wherein the training blade can be removed from the blade holder for replacement with an ice blade having cutting edges for use on-ice as desired, by releasing the retention mechanism; and wherein the tread in cross-section comprises a convex curve extending between the axial edges thereof.

15. The removeable off-ice training blade of claim 14 wherein the center of the convex curve is in the center of the tread, equidistant from the axial edges of the training blade.

16. A removeable off-ice training blade for use in a convertible ice skate, wherein the skate comprises a skate boot with a releasable skate blade holder attached thereto having:

a. an axial blade-holding groove along the bottom of the holder for engagement and alignment of a skate blade with a skating axis of a foot of the wearer extending from the heel to the toe of the boot; and b. a releasable retention mechanism for retaining the skate blade within the groove during use;

said blade having heel and toe ends corresponding the heel and toe of the skate boot and comprising:

j. an upper retention surface shaped to engage the interior of the blade-holding groove and be retained therein by the retention mechanism;

k. a lower tread surface to engage a non-ice training surface said tread surface having reflective no-cutting axial edges; and l. two side surfaces extending substantially perpendicularly from the tread to meet the upper retention edge;

wherein the non-cutting axial edges of the tread are shaped to negate any destruction of the non-ice training surface on which the training blade is used when attached to a skate boot; and wherein the training blade can be removed from the blade holder for replacement with an ice blade having cutting edges for use on-ice as desired, by releasing the retention mechanism; and wherein the tread is wider than the upper retention surface.

17. A convertible ice skate for training use by a wearer, said skate comprising:

a. a skate boot having a heel end and a toe end;

b. a releasable skate blade holder attached to the bottom of the skate boot comprising:

i. an axial blade-holding groove along the bottom of the holder for engagement and alignment of a skate blade with a skating axis of a foot of the wearer, said skating axis extending from the heel to the toe of the boot; and ii. a releasable retention mechanism for retaining the skate blade within the groove during use; and c. a removeable off-ice training blade having heel and toe ends corresponding the heel and toe of the skate boot, retained within the blade holder and comprising:

i. an upper retention surface shaped to engage the interior of the blade-holding groove and be retained therein by the retention mechanism;

ii. a lower tread surface to engage a non-ice training surface, said tread surface having reflective non-cutting axial edges; and iii. two side surfaces extending substantially perpendicularly from the tread to meet the upper retention edge;

wherein the non-cutting axial edges of the tread are shaped to negate any destruction of the non-ice training surface on which the training blade is used when attached to a skate boot;

wherein the tread has a high coefficient of friction to reduce the likelihood of slippage of the tread on the non-ice training surface; and wherein the training blade can be removed from the blade holder for replacement with an ice blade having cutting edges for use on-ice as desired, by releasing the retention mechanism.

18. A skate for training use by a wearer on a non-ice training surface, said skate comprising:

a. a skate boot having a heel end and a toe end;

b. an axial skate blade holder attached to the bottom of the skate boot for engagement and alignment of a skate blade with a skating axis of a foot of the wearer, said skating axis extending from the heel to the toe of the boot; and c. an off-ice training blade retained within the blade holder and having heel and toe ends corresponding the heel and toe of the skate boot and comprising:

i. an upper retention surface shaped to engage the interior of a blade-holding groove and be retained therein;

ii. a lower tread surface to engage a non-ice training surface, said tread surface having reflective non-cutting axial edges; and iii. two side surfaces extending substantially perpendicularly from the tread to meet the upper retention edge;

where in the tread has a high coefficient of friction to reduce the likelihood of slippage of the tread on the non-ice training surface; and wherein the non-cutting axial edges of the tread are shaped to negate any destruction of the non-ice training surface by the tread surface during use of the training blade on a skate boot thereon.

19. The ice skate of claim 18 wherein the blade holder permanently retains the training blade, comprising a permanent training skate for off-ice use.

20. The ice skate of claim 18 wherein the blade holder is releasable and permits the replacement of the training blade in the blade holder with an ice blade having cutting edges, being convertible between on-ice skating and off-ice training use.

21. A method of off-ice training for a skater on a non-ice training surface, said method comprising:

a. providing at least one convertible ice skate to be worn on a foot of the skater, said skate comprising:

i. a skate boot having a heel end and a toe end;

ii. a releasable skate blade holder attached to the bottom of the skate boot comprising:

1. An axial blade-holding groove along the bottom of the holder for engagement and alignment of a skate blade with a skating axis of a foot of the wearer, said skating axis extending from the heel to the toe of the boot; and 2. A releasable retention mechanism for retaining the skate blade within the groove during use; and iii. a removeable off-ice training blade having heel and toe ends corresponding the heel and toe of the skate boot, retained within the blade holder and comprising:

1. An upper retention surface shaped to engage the interior of the blade-holding groove and be retained therein by the retention mechanism;

2. A lower tread surface to engage a non-ice training surface, said tread surface having reflective non-cutting axial edges shaped to negate any destruction of the non-ice training surface; and 3. Two side surfaces extending substantially perpendicularly from the tread to meet an upper retention edge;

b. engaging a foot of the skater in said at least one said convertible ice skate;

c. engaging the skater in weight-bearing exercise movements on said at least one convertible ice skate on the non-ice training surface;

wherein the training blade of each convertible ice skate, via its non-cutting axial tread edges, does not damage the non-ice training surface;

wherein the tread has a high coefficient of friction to minimize the likelihood of slippage of the tread on the non-ice training surface; and the skater is able to simulate weight-bearing skate positioning and movements on the at least one convertible ice skate during the exercise movements.

22. The method of claim 21 wherein the number of convertible ice skates is one, worn on either foot of the skater.

23. The method of claim 21 wherein the number of convertible ice skates is two, worn on both feet of the skater.

* * * * *